US006128939A

United States Patent [19]

Fay et al.

[11] Patent Number: 6,128,939

[45] Date of Patent: Oct. 10, 2000

[54] ROLL TRAIN AND THE RELATIVE ROLLING PROCESS WITH AN IMPROVED YIELD

[75] Inventors: Gianfranco Fay, Milan; Alberto Augusti, Cusano Milanino, both of Italy

[73] Assignee: Techint Compagnia Tecnica Internazionale S.p.A., Milan, Italy

[21] Appl. No.: 09/044,912

[22] Filed: Mar. 20, 1998

[30] Foreign Application Priority Data

Mar. 20, 1997 [IT] Italy ..... MI97A0633

[51] Int. Cl.[7] ..... B21B 13/12

[52] U.S. Cl. ..... 72/235; 72/365.2

[58] Field of Search ..... 72/235, 234, 237, 72/224, 247, 365.2, 366.2, 249, 250, 226

[56] References Cited

U.S. PATENT DOCUMENTS

| | | | |
|---|---|---|---|
| 1,429,311 | 9/1922 | Albiez . | |
| 1,930,698 | 10/1933 | Stiefel | 72/224 |
| 2,400,690 | 5/1946 | Fisk | 72/235 |
| 3,513,679 | 5/1970 | Dechene et al. . | |
| 4,248,074 | 2/1981 | Fuhrmann et al. | 72/247 |
| 4,813,256 | 3/1989 | Engel | 72/247 |
| 5,363,682 | 11/1994 | Takeda et al. | 72/235 |

FOREIGN PATENT DOCUMENTS

| | | | |
|---|---|---|---|
| 0 342 403 | 11/1989 | European Pat. Off. . | |
| 0 549 896 | 7/1993 | European Pat. Off. . | |
| 365 075 | 12/1922 | Germany . | |
| 25 24 224 | 12/1976 | Germany . | |
| 40904 | 2/1987 | Japan | 72/235 |
| 8-001207 | 1/1996 | Japan . | |
| WO 91/01824 | 2/1991 | WIPO . | |

*Primary Examiner*—Rodney A. Butler
*Attorney, Agent, or Firm*—Oblon, Spivak, McClelland, Maier & Neustadt, P.C.

[57] ABSTRACT

A roll train includes a plurality stands positioned in series, wherein the stands are of at least two different types, one stand type being alternated with the other one. Each one of the stands has four rolls, opposed to each other in a two by two disposition, and at least one stand has two driven rolls opposed to each other wherein two stands in sequence have a rotational displacement angel of 45° about the axis of the rolls of the stands.

17 Claims, 6 Drawing Sheets

ROLL TRAIN AND THE RELATIVE ROLLING PROCESS WITH AN IMPROVED YIELD

BACKGROUND OF THE INVENTION

1. Field of the Invention

The present invention refers to a roll train and to a corresponding rolling process with an improved yield.

2. Discussion of the Background

In the rolling process field and in particular in the roll train field, there are known and proved processes and related stands used for the realisation thereof.

To this purpose, in order to realize the rolling step in the blanking phase, the mostly used type of stands is with three stacked rolls or cylinders, the so called "three-high" stand, the rolls being positioned horizontally and having unidirectional drive.

The rolling process is conducted by alternating the passes: a first pass is executed in one direction through the pair of rolls formed by the upper and the middle roll and a second pass is executed in the opposite direction through the pair of rolls formed by the lower and the middle roll. In order to execute such a process, the presence of an operator is generally needed; further, as well known, the productivity is quite low and the temperature of the billet undergoing the rolling process will be subjected to an excessive decrease. Further, a rolling process might be realized using a series of stands having two horizontal rolls, the so called "two-high" stand, positioned in sequence, with the rolls being positioned horizontally and having a unidirectional drive.

The stands positioned in this manner usually generate a torsional stress in the material undergoing the rolling process. This fact, especially in the rolling process of billets having significant dimensions and having the need for expensive toolings, usually causes material surface defects, due just to the torsional stress.

An attempt to solve such problem consists in alternating, in the rolling process, a so called "horizontal" two rolls stand with a so called "vertical" two rolls stand. In other words, these stands have, respectively, horizontal and vertical rolls and a unidirectional drive.

If, from one hand, the arrangement solves the above mentioned problem, on the other hand, it has limitations (especially in the case of special types of steel) on the reduction of section during the various phases of the rolling process, as for the circular/oval, square/diamond sections.

The problem occurs because of the significant material widening under the rolls.

It has to be understood that this widening, which can reach significant values (up to 30–40%), effects significantly the elongation, which, as known, is the true scope of the hot rolling. In order to solve these problems strictly related to the specific process, the section reduction, during the various passes under the various rolls in the realization sequence, has to be dimensionally limited and it is anyhow necessary, as said before, to be present in the more expensive vertical stands.

A blanking type process providing two rolls stands with horizontal rolls, but with a bidirectional drive is also known.

In this case, the rolling sequence is conducted by alternating the passes having opposite rotations or the drive motor.

In this specific case, it is then necessary to have a device for moving, in relation to the various channels, the material undergoing the rolling process and a device for turning the material around its longitudinal axis.

In this manner, the process has almost the same disadvantages as the "three-high" stand.

The same technical problems and disadvantages in the rolling process are found in an intermediate roll train, as presently known.

According to the oldest and most used process, a roll train is provided with stands having two opposed rolls with coplanar axes.

When all the stands are horizontal, a torsional stress is created between the stands, causing surface defects and a significant widening of the material under the rolls. As a consequence, there is a limitation in the reduction of the section during rolling passes. The stands can be alternated according to a horizontal/vertical sequence to avoid the torsional stress; such arrangement will need the use of expensive vertical stands.

In the intermediate rolling process the three high stands, with coplanar roll axes and with an angle displacement of 120° therebetween, are also of common use.

In this case, there are several stands in sequence with three motor driven rolls and with an angle displacement of 60° between two stands in sequence. Using the arrangement, even though a squeezing along three concentric directions is obtained, there is the need to realize a complex drive group of the three rolls which have to be simultaneously activated. This fact greatly increases the costs and the adjustment complexity to obtain proper working conditions. In summary, the known rolling processes with "two-high" stands or alternatively with "three-high" stands, present several significant technical problems in accordance to the various realisations previously examined in details.

In the two-high stands there might be problems related to the vertical stand cost, to the devices needed to move the material, to the need of operating personnel, to the low productivity and to the excessive temperature decrease.

In the three-high stands there are mainly problems related to the expensive mechanical structure to simultaneously drive the three rolls.

BRIEF DESCRIPTION OF THE DRAWINGS

The general purpose of the present invention is, then, essentially to solve the above mentioned problems and disadvantages, related to the known are, in a very simple and inexpensive effective way. In consideration of the above purpose, according to the present invention, a roll train and its related rolling process will be realised with an improved yield and a very low cost.

The above purpose is obtained by realising a roll train and the related rolling process having the features disclosed in the accompanying claims.

Figure 1:
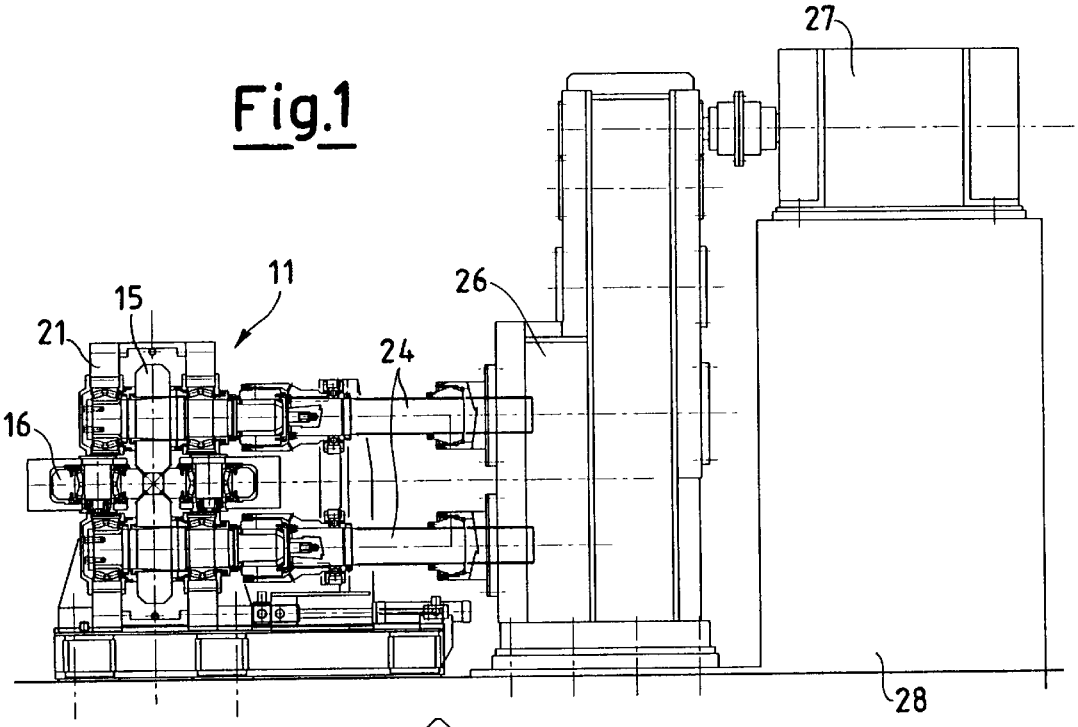

The structural and functional features of the present invention and its significant advantages in comparison with the known art will be more evident from the following description, referred to the attached drawings, wherein an example of embodiment, according to the invention, is shown.

Figure 2:
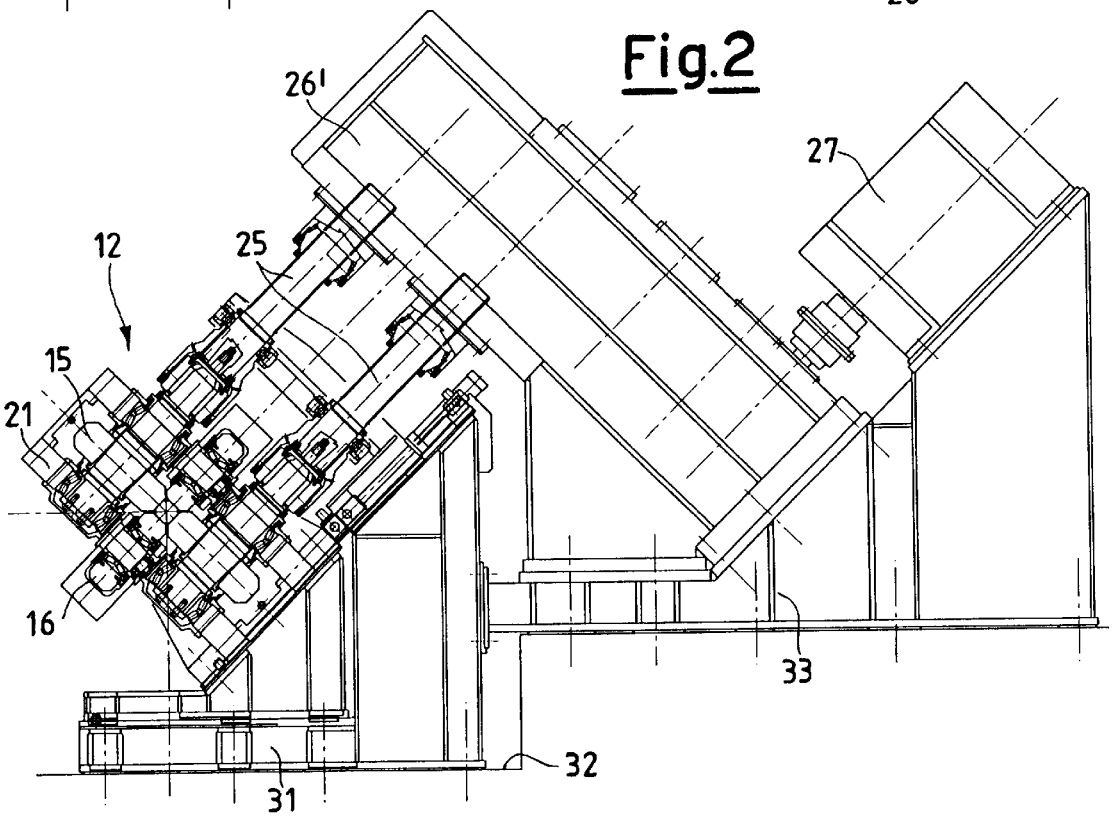
Figure 3:
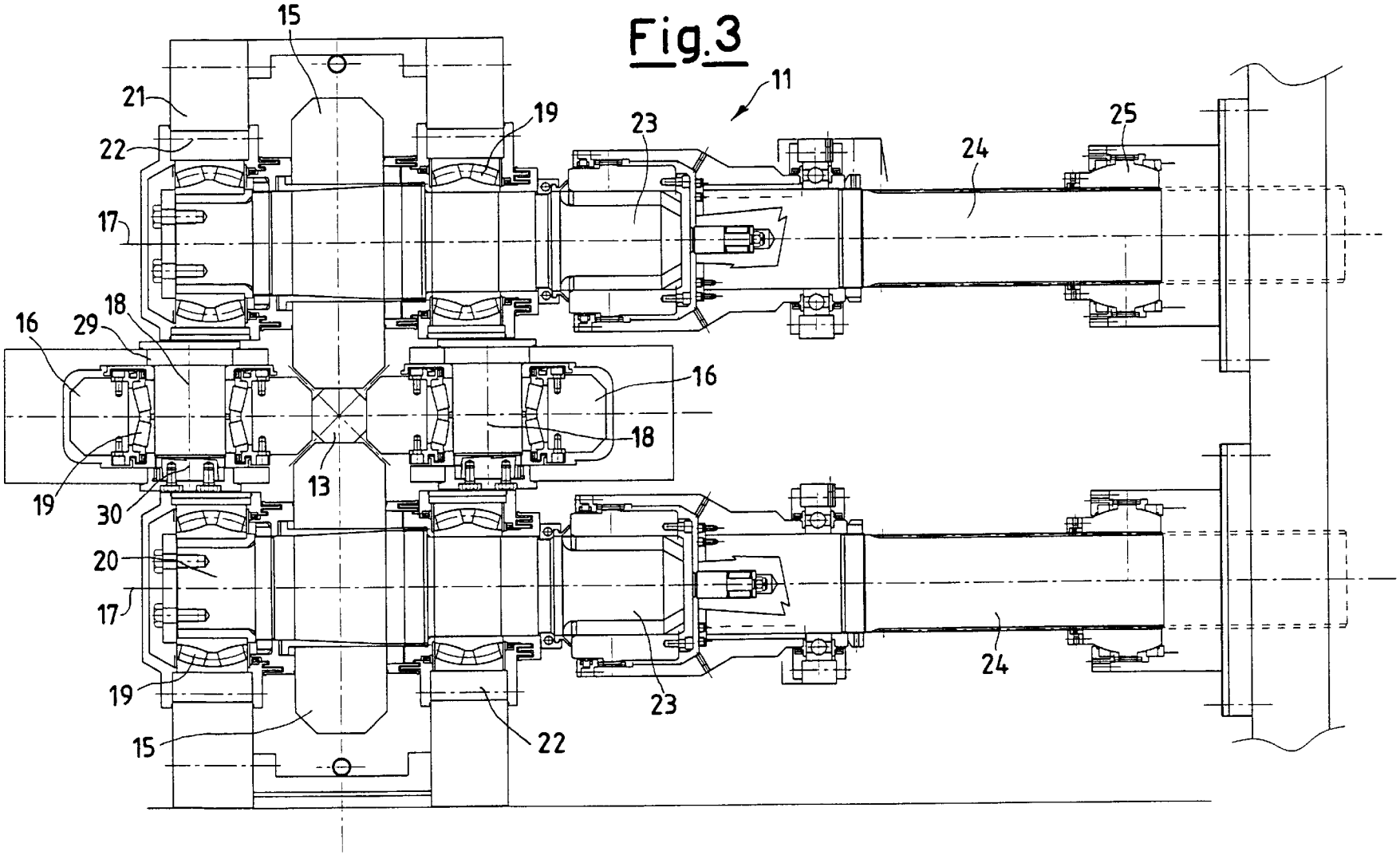
Figure 4:
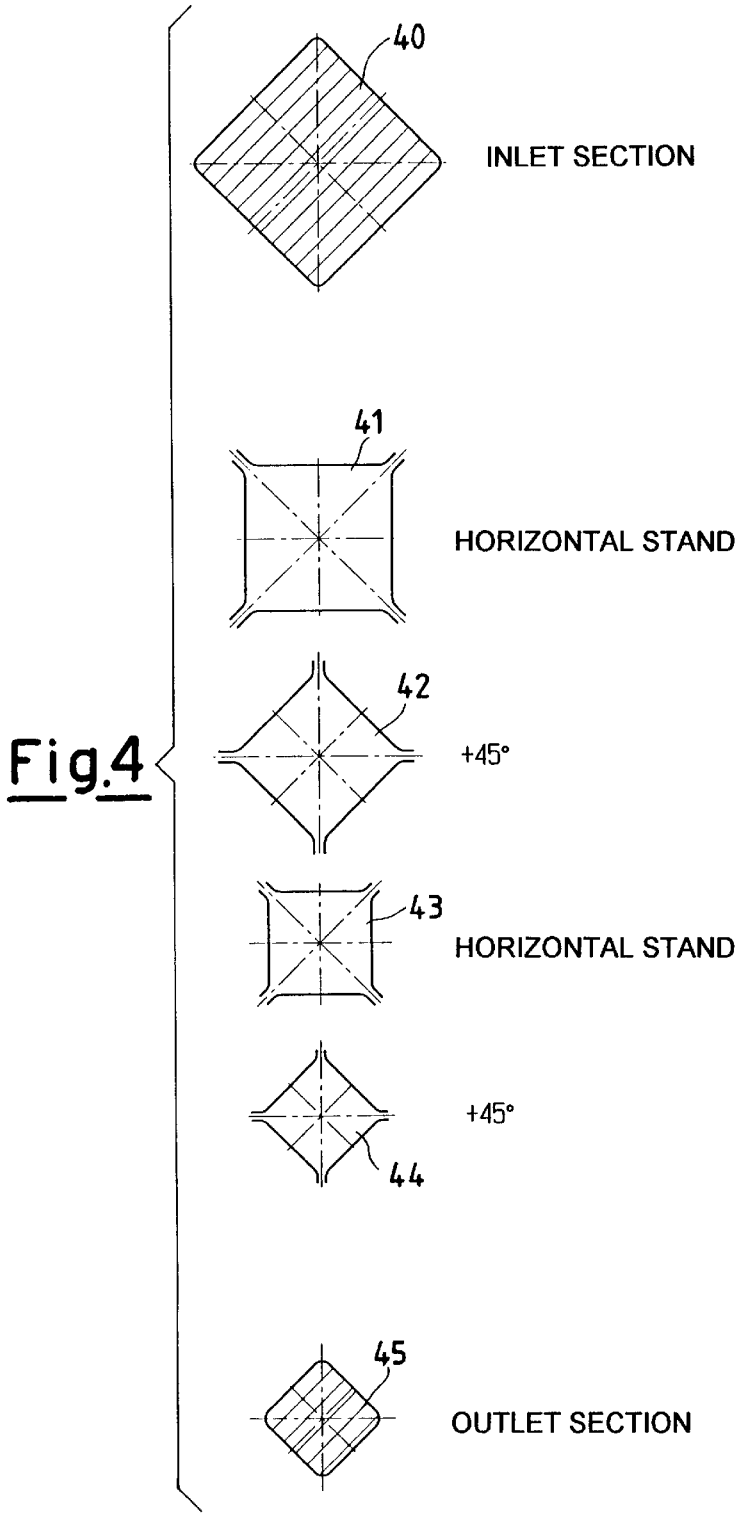
Figure 5:
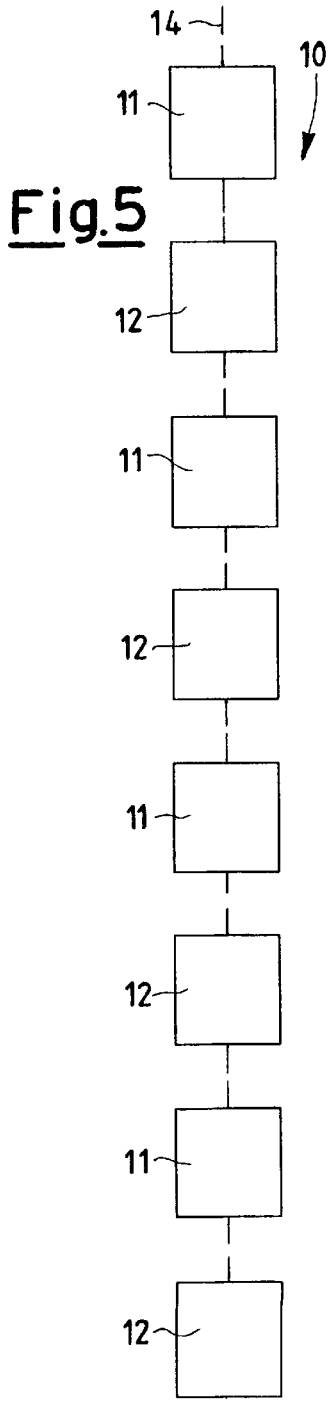
Figure 6A:
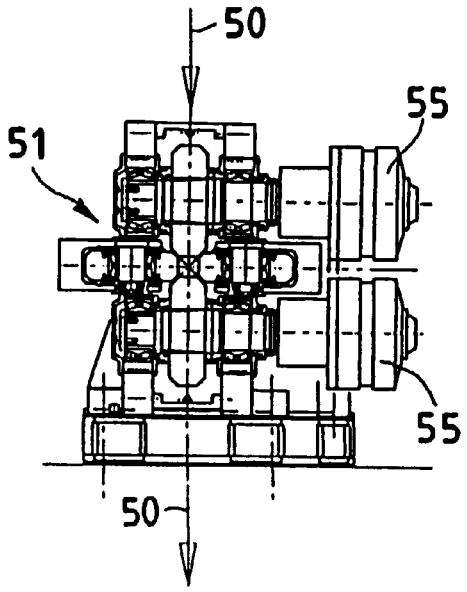
Figure 6B:
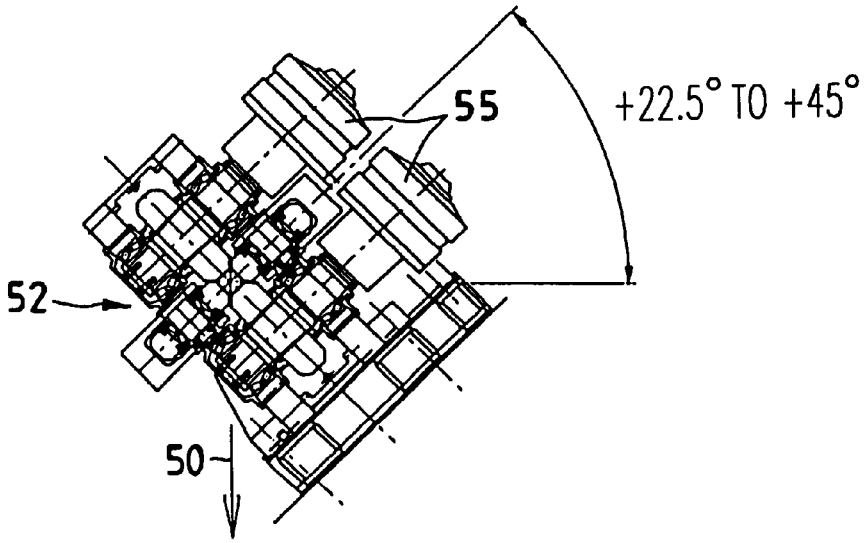
Figure 6C:
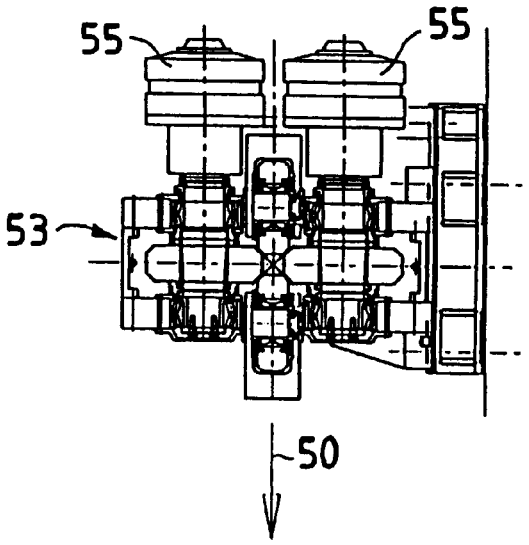
Figure 6D:
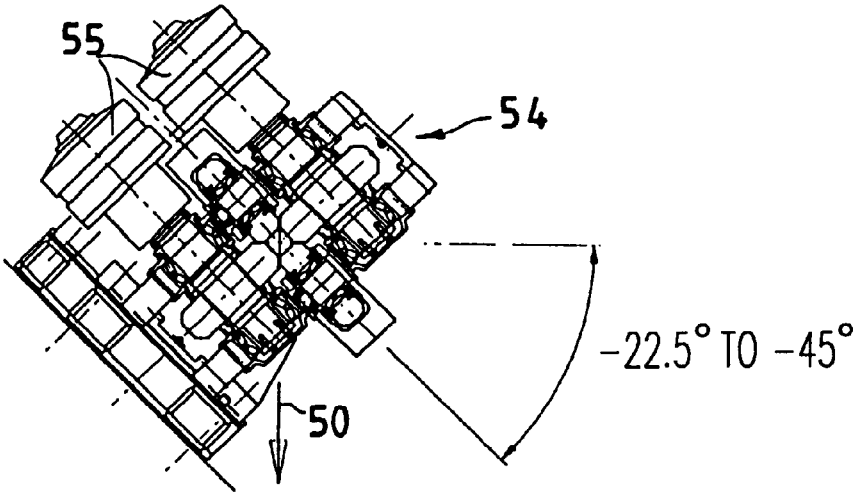

In the drawings:

FIG. 1 is a side elevation view, in partial section, of a first stand of the roll train of the invention;

FIG. 2 is a side elevation view, in partial section, of a second stand of the roll train of the invention;

FIG. 3 is an enlarged view of the same detail of the first and second stand of the roll train of the invention shown in FIGS. 1 and 2;

FIG. 4 shows a schematic rolling sequence according to the invention obtained by means of subsequent passes through a series of stands such as the ones shown in the preceding FIGS. 1 and 2, such stands being part of a roll train;

FIG. 5 shows a block diagram of the roll train according to the invention; and FIG. 6 shows a roll train or part thereof, wherein the single stands are presented in a schematic elevation view.

Figure 7:
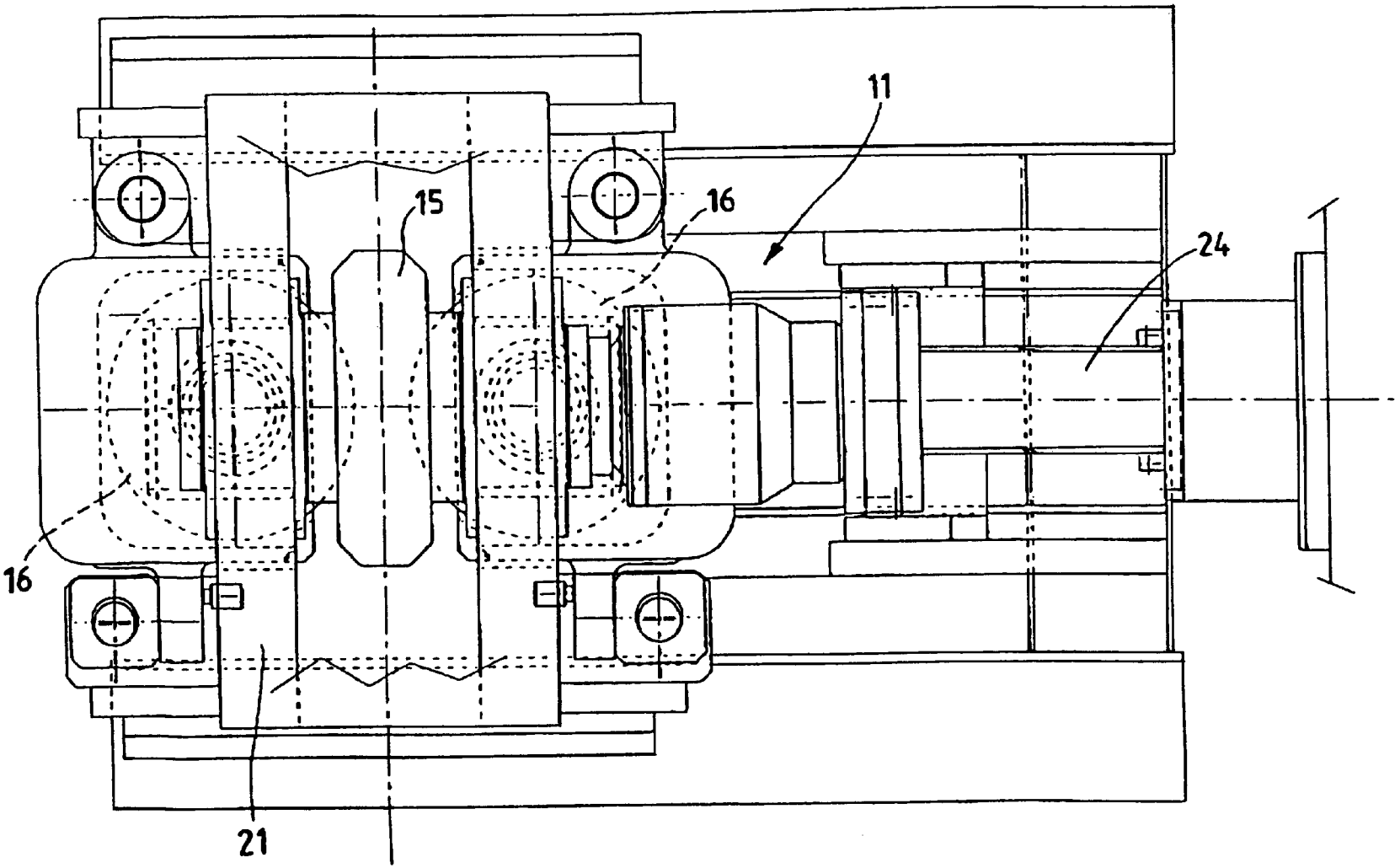

FIG. 7 is a top view of the stands showing two pairs of driven rolls and two pairs of idle rolls.

First, with reference to FIG. 5, a block diagram (indicated by numeral 10) is described wherein the roll train is shown in accordance with the invention, said roll train, in the shown example, comprises a series of eight stands (positioned in sequence) of the types 11, 12, according to the invention as well.

All the stands, generally, are four roll stands ("four-high"), having two opposed rolls in a two by two disposition. Stands 11 and 12 are positioned one subsequent to the other and between two stands in sequence a rotation or a displacement of a certain angle, equal to 45°, is provided between the axes of the same rolls of two stands in sequence.

A material or a blank to be rolled, indicated by numeral 13, is driven through a series of rolling rolls with rotation axes positioned on the four sides of a four-sided geometrical figure with parallel opposite sides and with perpendicular consecutive sides, as in a square.

The section reduction is obtained more easily when the widening is at minimum level with a constant geometric shape section.

The shape section can be alternatively an irregular octagon with sides of different lengths or a square. The rolling stand arrangement according to a scheme similar to the one shown, independently of their number, is obtained by alternating stand 11 to stand 12 having a displacement angle, as said before, of 45°.

In order to have such a displacement, the stands might have one of the following alternate disposition:

a) horizontal stand, +45° rotated stand, horizontal stand, +45° rotated stand, and so on for the required number of stands.

b) horizontal stand, −45° rotated stand, horizontal stand, −45° rotated stand, and so on for the required number of stands.

c) +22.5° rotated stand, −22.5° rotated stand, +22.5° rotated stand, −22.5° rotated stand, and so on for the required number of stands.

In all these cases the rolling longitudinal axis, indicated by numeral 14, remains constant.

The starting billet, usually with a square shape, is rolled into an irregular octagon shape having sides of different length, as already said, or into a square shape, exercising pressure on the shorter sides, if an octagonal shape is obtained, or on the corners, if a square shape is obtained.

In order to facilitate the material feeding between one stand and the following one, the driven rolls might have a diameter larger than the diameter of the idle rolls.

The rotational axes of the idle rolls might lay in a plane different from the plane of the driven rolls.

The displacement might be downstream (or upstream) for a small amount (such small displacement is equal to a percentage of the side of the inlet section and constitute the maximum value of the displacement).

Preferably, the rolls have a flat table, but they can also have a slightly concave or convex table in order to improve the stability of the material to be rolled.

The position of the driven rolls constitutes a particular feature which can be selected in respect to specific need and of the type of material to be rolled (plain steel, special steel, etc.).

According to a first general embodiment, in the odds stands 11 there are two driven rolls 15, preferably with horizontal axes 17, and two idle rolls 16, with axes 16 rotated of 90° with respect to axes 17.

In the second stand 12 the driven rolls are the horizontal ones of the first stand, rotated of 45° in respect to the horizontal axis.

In a further second embodiment, the driven rolls of the even stands 12 are driven independently, for example by means of hydraulic motors (not shown) in respect to the driven rolls 15 of the odd stands 11. Further, it is not necessary that, in each stand, there are provided two driven rolls 15, opposed to each other and two idle rolls 16, also opposed to each other.

In a third embodiment, for instance, an intermediate stand with four idle rolls 16 between two non consecutive stands with four driven rolls 15 can be provided.

Preferably, the stand with driven rolls is the one with a horizontal axis 17 of the pair of rolls 15, meanwhile the other axis 17 is vertical. In this specific case wherein the intermediate stand has four idle rolls 16, the material 13 is pushed through.

FIGS. 1–3 show how to realize the above mentioned single stands 11 and 12. The examples show stands comprising a pair of driven rolls 15 opposed to each other and a pair of idle rolls 16 opposed to each other. It is obvious that the stands with four idle rolls have an even simpler structure.

FIG. 1 shows a first stand 11 wherein the driven rolls 15 have horizontal axes 17 and are generally supported, as better shown in FIG. 3, by opposed rolling bearings 19 positioned on the necks 20 thereof and such bearing can even sustain axial thrust. Stroller 21 also supports the idle rolls 16 as illustrated in FIG. 3.

The symmetrical adjustment of the driven rolls 25 in relation to the shoulders 21 of the stand 11 is obtained by means of came 22.

These rolls 15 driven by an extension of the tree end 23 are connected to elongated members 24, provided, for instance, with teeth 25 and said members are of the retractable type, which can be connected to a main reduction gear 26.

The main reduction gear 26 is driven by a motor 27 positioned on a flat bed 28.

The idle rolls 16 have instead vertical axes 28 and are adjusted, in respect to the shoulders 21, on one side, by means of a cam 29 and, on the other side, by means of a hinge device 30.

However, both the driven rolls 15 and the idle rolls 16 can be positioned by means or equivalent support systems which are suitable to adjust the proper positioning.

FIG. 2 shows a second stand 12 wherein the driven rolls 15 have axes 17 rotated or displaced by a 45° angle in respect to the horizontal axis of the first stand. The general arrangement is equivalent to the one previously described except for the main reduction gear 26' which is overturned.

The stand 12 is positioned on an inclined counterframe 31, fixed to the stand itself and movable together in relation to the supporting bedplate 32. In such way a structure similar to the one of the first stand 11 can be used.

The main reduction gear 26' and the motor 27 are also placed on a further inclined bedplate 33.

The stands can be easily substituted using a crane or a quick change device, once the elongated members 24 have been taken back after having disengaged and disconnected the toothed connection 25.

FIG. 4 shows a schematic rolling sequence according to the invention, which is obtained through subsequent passes in a series of stands (four) 11 and 12, as previously described and shown in FIGS. 1 and 2, said stands are part of a roll train according to the invention.

In this sequence, for instance, it can be seen that starting from an inlet section square shape of the billet 40, subsequent sizing devices 41–44 are to be gone through, said sizing devices having a similar shape rotated by a 45° angle in relation to the preceding one and with decreasing sides.

It is understood that the billet section contained in the various sizing devices has either a irregular octagon section or a square section, until the required final outlet section 45 is obtained. The squeezing pressure in the various sizing devices will be exercised, as already said, on the shorter sides of the different sections, in case of an irregular octagon shape, or on the section corners, in case of a square shape.

In particular, it has been noticed that the sequence with subsequent octagons greatly reduces the widening of the material and, as a consequence, reduces the rolling stands.

According to what has been mentioned hereinabove and with reference to the various figures, it is clear that the roll train of the present invention and the related rolling process are particularly advantageous.

In fact, the possibility of obtaining highly reduced sections, even with materials, which do not tolerate well any widening as the special steel, is realized. To this extent, it is known that their low plasticity might cause surface cracks and other defects.

Further, a section reduction, with minimum change in widening and hardly influenced by the materials to be rolled, is obtained. This is in contrast with the significantly different widening obtained in the materials of the roll trains according to the known art.

Rolling process rolls, having a lateral almost flat surface, are advantageously used. These rolls experience reduced wear in comparison with the grooved rolls of the known art. In these grooved rolls, it is known that the wear changes in relation to the distance from the rolling axis of the various contact points between the material and the roll.

Therefore, the technical problems of the known art are solved and the purpose of the invention, as indicated in the preamble of the description, is attained.

The embodiments of the invention might be different from the previously described ones, which have been shown, as a non limiting example, in the accompanying drawings.

A further advantage is that the rolling toolings are generally simplified. Further, a roll train realised according to the invention is particularly compact and short compared to the known train since there is no need for creating loops.

FIG. 6 shows a further example of a roll train or of at least a part thereof. In this example, the first four stands of the roll train are shown in a schematic front elevation view, wherein the rolling direction is indicated by arrows 50.

In this example, an alternative embodiment is used, wherein it is provided an arrangement in sequence, but with a different positioning, of the stands always of the same type.

Therefore, the following sequence is obtained: horizontal stand 51, +45° rotated stand 52, vertical stand 53, −45° rotated stand 54, and then the sequence is repeated inside the train.

In this way, the fiber stretches are compensated, since all the various perimeter areas of the section are stretched in four subsequent steps and the cycle is repeated every four stands. Hydraulic drive motors 55 can be used in order to simplify the mechanical construction of this arrangement with four stands, each one rotated by a 45° angle in respect to the following one.

This last arrangement will eliminate the non uniform distribution of the fiber stretches throughout the section of the material to be rolled.

The scope of protection of the invention is defined by the accompanying claims.

The Italian priority application No. MI97A 000633 is herein incorporated by reference.

What is claimed is:

1. A roll train, comprising:

a plurality of stands positioned in series, wherein said stands include at least a first and second stand which are of different types, said first stand being alternated with said second stand, wherein each of said first and second stands has four rolls, opposed to each other in a two-by-two disposition, and at least one of said stands has two driven rolls opposed to each other, and wherein two of said stands in sequence have one of a rotational angle and a displacement angle of 45° about axes of said rolls and wherein the second stand has two pairs of idle rolls.

2. A roll train according to claim 1, wherein said first stand has at least one pair of rolls with axes parallel to a direction of feeding of a material to be rolled through said stands.

3. A roll train according to claim 1, wherein said first stand is rotated by a 22.5° angle in relation to a direction of feeding of a material to be rolled through said stands and the second stand is rotated by a −22.5° angle in relation to the direction of feeding of the material.

4. A roll train according to claim 1, wherein said stand comprises a plurality of shoulders which support one pair of driven rolls and one pair of idle rolls rotated by a 90° angle in relation to said driven rolls, such that rotational axes thereof are positioned on four sides of a four-sided geometrical figure with parallel opposed sides and with perpendicular consecutive sides.

5. A roll train according to claim 1, wherein rotational axes of the idle rolls lie outside a plane of the rotational axes of the driven rolls.

6. A roll train according to claim 4, wherein said driven rolls and idle rolls (16) are supported by opposed rolling bearings, and a mechanism is provided for symmetric adjustment of said rolls in relation to said shoulders.

7. A roll train according to claim 4, wherein said driven rolls and said idle rolls are connected via elongated members to a main reduction gear connected to a motor.

8. A rolling process performed on a blank with a four-sided shape, which comprises:

performing a consecutive series of section reductions on the blank by using sizing devices with octagonal shape billet sections, which have progressively decreasing sides;

rotating each of said sizing devices by a 40° angle in relation to the preceding sizing device wherein said octagonally shaped billet sections have sides with different lengths; and applying a squeezing pressure by said sizing devices on shorter side portions of the different sections.

9. A roll train comprising:

a plurality of stands positioned in series wherein said stands include a first and second stand which are of different types, said first stand being alternated with said second stand, wherein each of said first and second stands has four rolls, opposed to teach other in a two by two disposition, at least one of said stands has two driven rollers opposed to each other, and wherein two of said stands in sequence have one of a rotational angle and a displacement angle of 45° about axes of said rolls and wherein said rolls include idle rolls and the diameters of said driven rollers are larger than the diameters of the idle roll.

10. A roll train according to claim 9, wherein said first stand has at least one pair of rolls with axes parallel to a direction of feeding of a material to be rolled through said stands.

11. A roll train according to claim 9, wherein said stand is rotated by a 22.5° angle in relation to a direction of feeding of a material to rolled through said stands and the second stand is rotated by a −22.5° angle in relation to the direction of feeding of the material.

12. A roll train according to claim 9, wherein said first and second stands have two opposed driven rolls.

13. A roll train according to claim 9, wherein said rolls have a flat table.

14. A roll train according to claim 9, wherein said stand comprises a plurality of shoulder which support one pair of the driven rolls and one pair of the idle rolls rotated by 90° angle in relation to the driven rolls, such that rotational axes thereof are positioned on four sides of a four-sides geometrical figure with parallel opposed sides and with perpendicular consecutive sides.

15. A roll train according to claim 9, wherein rotational axes of the idle rolls lie outside a plane of the rotational axes of the driven rolls.

16. A roll train according to claim 14, wherein said driven rolls and said idle rolls are supported by opposed roller bearings and a mechanism is provided for symmetric adjustment of said rolls in relation to said shoulders.

17. A roll train according to claim 14, wherein said driven rolls and said idle rolls are interconnected by elongated members to a main reduction gear connected to a motor.

* * * * *